US005690088A

United States Patent [19]

Ruble

[11] Patent Number: 5,690,088

[45] Date of Patent: Nov. 25, 1997

[54] ROTATING ENCLOSED QUIVER

[76] Inventor: Steven W. Ruble, Rte. 3, Box 160, Clearville, Pa. 15535

[21] Appl. No.: 654,329

[22] Filed: May 28, 1996

[51] Int. Cl.[6] ..... F41B 5/06

[52] U.S. Cl. ..... 124/25.7; 124/41.1; 224/916

[58] Field of Search ..... 124/25.5, 25.7, 124/41.1, 44.5, 86, 88; 206/315.11; 224/916

[56] References Cited

U.S. PATENT DOCUMENTS

| | | | |
|---|---|---|---|
| 2,956,603 | 10/1960 | Maule | 124/25.7 X |
| 2,984,277 | 5/1961 | Neff | 124/25.7 X |
| 3,116,730 | 1/1964 | Tingley | 224/916 X |
| 3,337,099 | 8/1967 | Rose | 224/916 X |
| 3,716,174 | 2/1973 | Ehlert | 124/25.7 X |
| 3,777,734 | 12/1973 | Rose | 124/25.5 |
| 4,541,403 | 9/1985 | DeBlois | 124/25.7 X |

*Primary Examiner*—John A. Ricci

[57] ABSTRACT

The present invention is directed to a quiver which can protect arrows from both the weather and other physical damage by securing the arrows individually inside of a protective covering. The device has a cylindrical housing member with a longitudinal opening therein, a lid with a closed-cell foam filler for receiving the point of an arrow therein, a rotating arrow holder member attached to the lid, a door connected to the rotating arrow holder and a locking mechanism for maintaining the door in a closed or open position.

14 Claims, 3 Drawing Sheets

ROTATING ENCLOSED QUIVER

BACKGROUND OF THE INVENTION

This invention relates to archery and hunting. More particularly this invention relates to quivers which are used to carry the arrows used in archery.

The basic construction of arrows has remained substantially unchanged for many years. Generally, arrows have a long straight shaft, a pointed tip at one end and fins made of feathers at the opposite end. The feathers are critical to the arrow's flight performance. They are delicate and can by easily crushed beyond repair. Additionally, weather conditions such rain, sleet and snow cause the feathers to become matted down making the arrow unusable.

Older quivers were open pouches into which the arrows were placed. These pouches did not prevent damage to the arrows caused by the arrows bouncing around inside the pouch and hitting each other. The arrows could easily become bent or damaged.

Newer quivers have been designed to protect the arrows from such contact damage by securing them in a spaced apart relationship at both the point and hock ends. However, these quivers are completely open to the environment and leave the arrows totally exposed. Standard quivers do nothing to protect the arrows from the elements or damage occuring during normal use. If the hunter lays the quiver and/or bow down the wrong way the feathers and/or arrows may be damaged. If the hunter accidentally drops the quiver or bow, or falls from his perch, the arrows could be bent or otherwise damaged.

Therefore, there is a need for a quiver which can both protect the arrows from bumping against each other and shield the arrows from weather conditions and other physical damage.

SUMMARY OF THE INVENTION

The present invention is directed to a device which satisfies the need for a quiver that can protect the arrows from both the weather and other physcial damage by securing the arrows individually inside of a protective covering. The device has a cylindrical housing member with a longitudinal opening therein, a lid containing a closed-cell foam filler for receiving the point of an arrow therein, a rotating arrow holder member attached to the lid, a door connected to the rotating arrow holder and a mechanism for locking the door in an open or closed position and stopping at each arrow position.

OBJECTS OF THE INVENTION

Therefore it is an object of this invention to provide for an improved quiver which can protect arrows from weather and other physical damage.

It is another object of this invention to provide for a light weight quiver which has rigid outer covering that encloses and protects the arrows.

It is still another object of this invention to provide for an enclosed quiver which has a rotating lid and arrow retainer ring.

It is still yet another object of this invention to provide for an enclosed quiver with an opening for inserting and retrieving arrows.

It is yet another object of this invention to provide for a rotating door with a locking mechanism on an enclosed quiver.

To provide for a quiver which conceals the arrows inside of an enclosure from the view of a child or an animal is another object of this invention.

An additional object of this invention is provide for an enclosed rotary quiver which can be bow mounted.

It is still an additional object of this invention to provide for a quiver which can be used for storage or safe transport of arrows.

It is yet an additional object of this invention to provide for a quiver which can prevent arrows from vibrating down during shooting or use.

BRIEF DESCRIPTION OF THE DRAWINGS

These and other features, aspects and advantages of the present invention will become better understood with regard to the following description, appended claims, and accompanying drawings wherein:

DETAILED DESCRIPTION OF THE DRAWINGS

Figure 1:
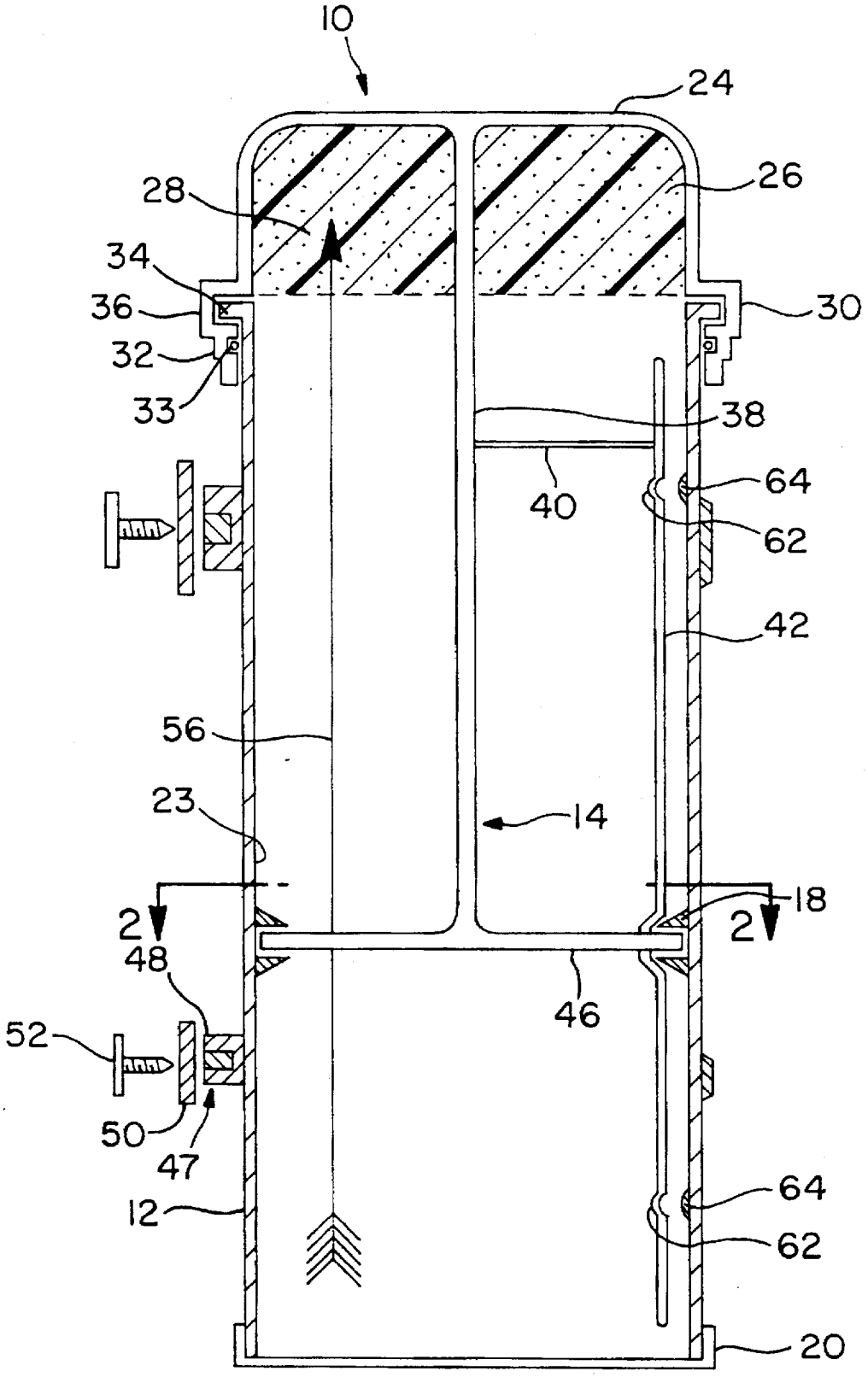
FIG. 1 is a partial cross-section view of the present invention along its longitudinal center line.
Figure 2:
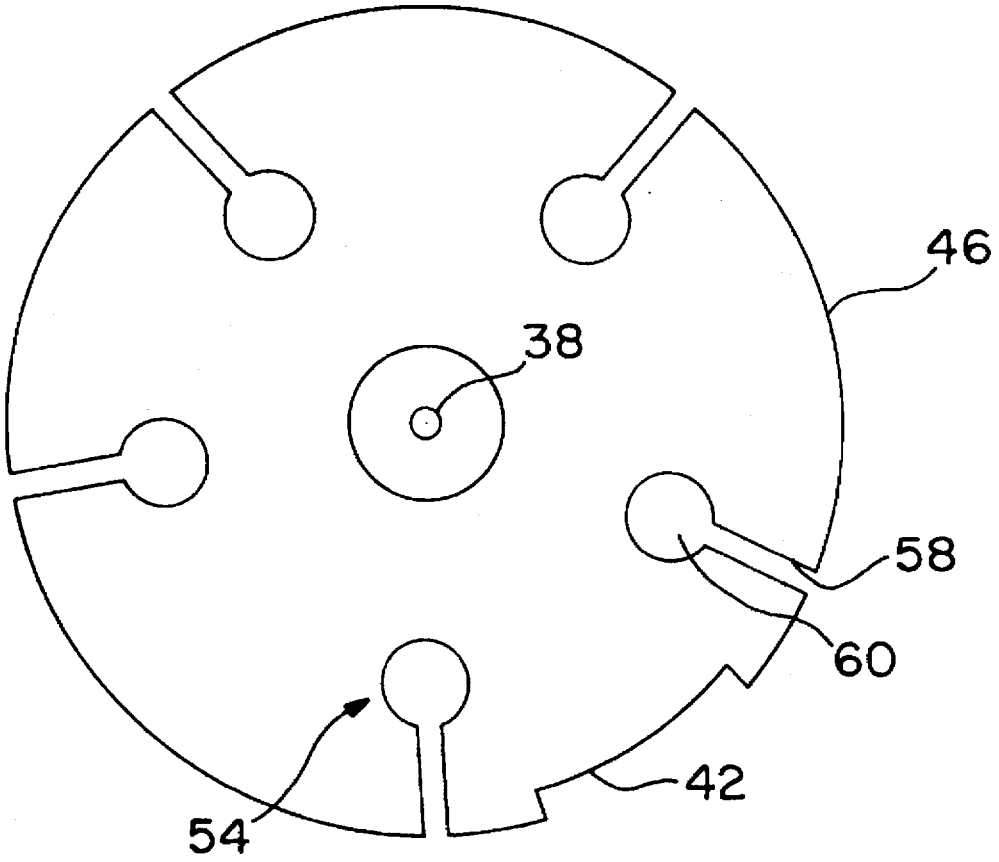
FIG. 2 is a view of the arrow retainer ring of the device of FIG. 1 along line 2—2.
Figure 3:
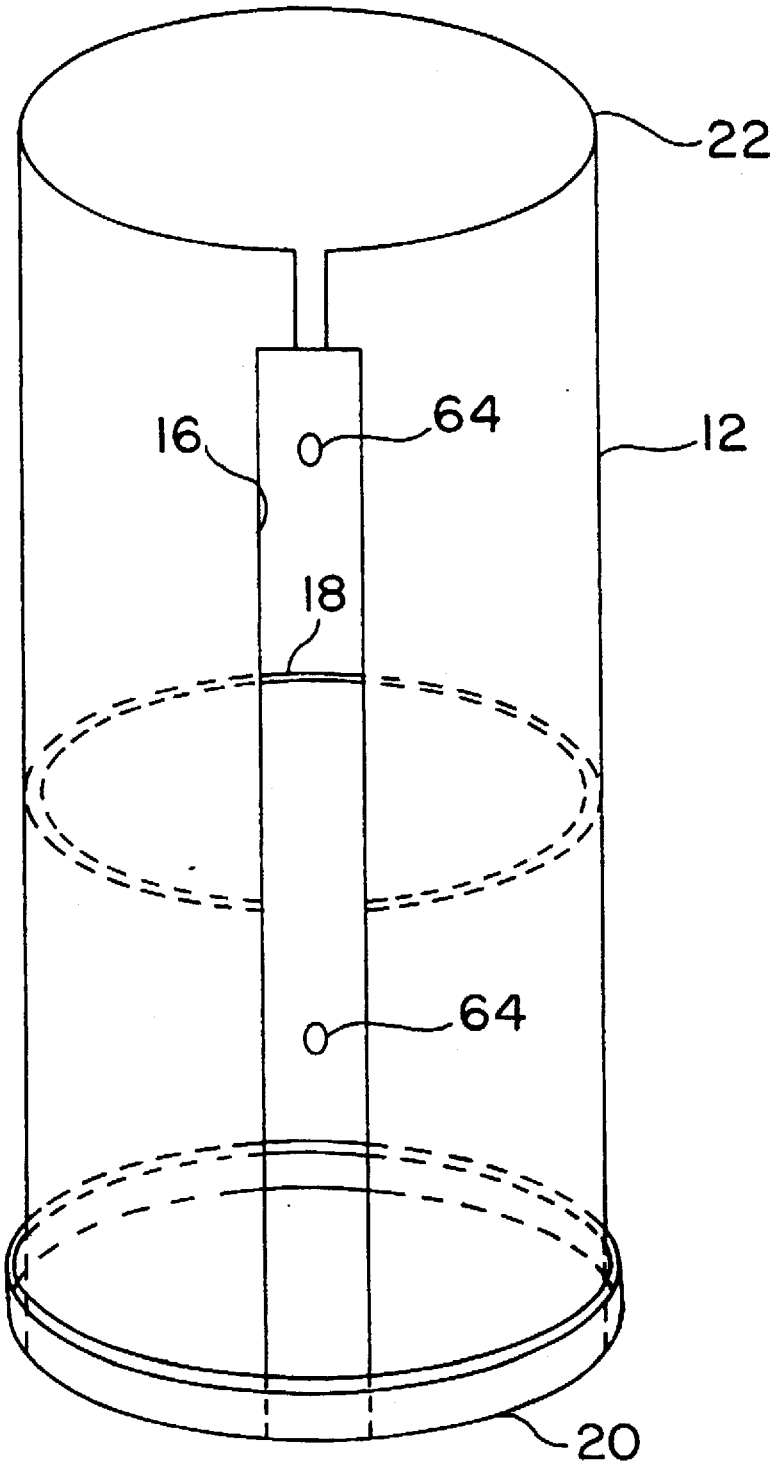
FIG. 3 is a perspective view of the outer shell portion of the device of in FIG. 1.

Referring now to FIGS. 1, 2 and 3, there is shown the preferred embodiment of the present invention. The quiver 10 has two major components, the outer shell 12 and the rotating arrow retainer 14. These two components fit together to form a single quiver 10 which can hold several arrows and protect them from the weather or other physical damage.

The outer shell 12 shown in FIG. 3 has a longitudinal opening 16, which provides access for insertion and removal of arrows. There is a bottom cap 20 which is secured to the bottom of the outer shell 12. Alternately, the bottom cap 20 and the bottom of the outer shell 12 could be threaded such that the bottom cap 20 would screw onto the outer shell 12. The top edge of the outer shell 12 has an extended lip 34.

The rotating arrow retainer 14 is formed of a rotator lid 24, a connector member 38, an arrow retaining ring 46, a door 42 and a support member 40. The rotator lid 24 fits onto the top of the outer shell 12. The rotator lid 24 is filled with a foam material 26 which is not easily deformable and is water resistant, for example closed-cell foam. This foam material 26 receives and protects the point 28 of the arrow 56.

The bottom edge of the rotator lid 24 has a double notched construction with one notch 36 fitting over the lip 34 of the outer shell 12 and the second notch 32 receiving an o-ring 33 therein. The o-ring 33 acts to prevent vibration of the rotator lid 24 against the outer shell 12.

The outer shell 12, the rotator lid 24 and the bottom cap 20 should be formed of a rigid lightweight material such as plastic. Other materials, such as aluminum, steel or a metal composite, could be substituted for plastic without departing from the intended scope of the attached claims.

The arrow retainer ring 46 is circular in shape for easy rotation. Along the inside wall 23 of the outer shell 12 there is a raised groove 18. The outer edge of the arrow retaining ring 46 fits into the raised groove 18. The arrow retaining ring 46 and the rotator lid 24 are connected in a spaced apart relationship by the connector member 38, such that as the rotator lid 24 is turned, the arrow retaining ring 46 is rotated as well.

The arrows 56 are secured within openings or arrow retaining spaces 54 in the arrow retainer ring 46, as shown in FIG. 2. The openings 54 are somewhat keyhole-shaped having a wide closed end 60 and a narrow open end 58. The arrows are forced in through the narrow end 58 and are retained in the wide closed end 60. The arrow retainer ring 46 is preferably formed of a rubber/plastic combination, such that it is flexible for insertion and removal of arrows yet sturdy enough to rotate within the raised groove 18. As the rotator lid is turned by the hunter the arrow retaining ring 46 is also turned thereby rotating the arrows 56.

Attached to the rotating arrow retainer 14 is the door 42. The door is also attached at its top end to the connector member 38 by support member 40. This support member 40 provides additional support for the door 42, but is not essential to the rotational function of the device 10. In the closed position, the door 42 will block the longitudinal opening 16 in the outer shell 12.

In order to open the quiver 10 to insert or remove arrows 56, the rotator lid 24 is manually turned, thereby moving the door 42 away from the longitudinal opening 16, and inside of the outer shell 12. The door 42 and interior of the outer shell 12 are provided with a slot 62 and tab 64 type locking mechanism such that the door can be locked in any position. Several tabs 64 are positioned along the interior 23 of the outer shell, such that as the rotating arrow retainer 14 is rotated, the slot 62 will fit over the tab and lock the position of the door 42. With each partial rotation between adjacent tabs, another arrow or empty retaining space 54 is positioned in the opening 16. A full rotation will expose each retaining space 54 or arrow and complete with the door 42 in the closed position.

With the door in the closed position, the arrows 56 are completely encased within the quiver 10. The arrows 56 are protected from any inclement weather conditions and possible physical damage. When closed, the quiver 10 also prevents a child from viewing its contents, thereby possibly safeguarding the child from accidental injury from handling the arrows 56. Additionally, the quiver 10 will prevent any animals from seeing the arrows 10 as well. The quiver 10 can also serve as a traveling case for the arrows 56 as they are protected in a crush-proof container.

Two screw attachments 47 are provided on the exterior of the outer shell 12. There is a threaded screw receptacle 48, a washer 50 and a screw 52. These screw attachments 47 can be used to attach the quiver 10 to a bow, a bag or a carrying strap.

Although the present invention has been described in considerable detail with reference to the preferred embodiment thereof, other versions are possible. Therefore, the spirit and scope of the appended claims should not be limited to the description of the preferred embodiment contained herein.

I claim:

1. A quiver for arrows, comprising:

a housing provided with openings in opposite ends of said housing and a third opening in said housing, said third opening being at least large enough to permit insertion and removal of arrows;

cover for fitting onto one of said openings in said opposite ends of said housing and capable of rotating about one of said opposite ends of said housing;

means for retaining said arrows in said housing having a plurality of notch-shaped openings therein, each notch-shaped opening receiving one of said arrows therein, said means for retaining said arrows being attached to said cover for rotation therewith; and a means for opening and shutting said third opening, said means for opening and shutting said third opening being attached to said means for retaining said arrows.

2. A quiver for arrows as recited in claim 1 wherein said housing is cylindrical in shape.

3. A quiver for arrows as recited in claim 1 wherein said cover is filled with a foam core for receiving a tip of an arrow therein.

4. A quiver for arrows as recited in claim 1 further comprising a raised groove formed along an interior wall of said housing for receiving an edge of said means for retaining said arrows therein such that said means for retaining said arrows rotates within said raised groove.

5. A quiver for arrows as recited in claim 1 further comprising a cap member fitting onto said other opposite end of housing.

6. A quiver for arrows as recited in claim 1 further comprising a locking mechanism for locking said means for opening and shutting said third opening in an open or closed position.

7. A quiver as recited in claim 6 wherein said locking mechanism is comprised of a series of tabs positioned along an interior wall of said housing and a corresponding slot on said means for opening and shutting said third opening such that when said tab is positioned in said slot, said means for opening and shutting said third opening is locked in that position.

8. A quiver for arrows as recited in claim 1 wherein said cover and said means for retaining said arrows are spaced apart and connected by a rotating member such that they rotate together.

9. A quiver for arrows a recited in claim 1 further comprising an extended lip portion on one of said ends of said housing and fitting into said cover and an O-ring positioned between said cover and said housing.

10. A quiver for arrows as recited in claim 1 further comprising an attachment member secured to an exterior of said housing for attaching said housing to another object.

11. A quiver for arrows as recited in claim 1 wherein said housing is a rigid cylindrical member.

12. A quiver for arrows as recited in claim 1 wherein said cover is a lid having a notched edge.

13. A quiver for arrows as recited in claim 1 wherein said means for retaining said arrows is a ring and said notch-shaped openings are flexible.

14. A quiver for arrows as recited in claim 1 wherein said means for opening and closing said third opening is sufficient in size to close said third opening.

* * * * *